US009027812B2

(12) United States Patent
Lester

(10) Patent No.: US 9,027,812 B2
(45) Date of Patent: May 12, 2015

(54) BACKPACK FRAME

(75) Inventor: Jeffrey Travis Lester, Eagar, AZ (US)

(73) Assignee: Hunt Hard, LLC, Eager, AZ (US)

( * ) Notice: Subject to any disclaimer, the term of this patent is extended or adjusted under 35 U.S.C. 154(b) by 326 days.

(21) Appl. No.: 13/208,280

(22) Filed: Aug. 11, 2011

(65) Prior Publication Data

US 2012/0234879 A1 Sep. 20, 2012

Related U.S. Application Data

(60) Provisional application No. 61/465,007, filed on Mar. 14, 2011.

(51) Int. Cl.

| | |
|---|---|
| ***A45F 3/00*** | (2006.01) |
| ***F16M 11/00*** | (2006.01) |
| ***A47G 29/00*** | (2006.01) |
| ***A45F 3/08*** | (2006.01) |

(52) U.S. Cl.

CPC ..... *A45F 3/08* (2013.01); *A45F 2003/001* (2013.01); *A45F 2003/003* (2013.01)

(58) Field of Classification Search

USPC ..... 224/628; 248/682, 685, 686, 693

See application file for complete search history.

(56) References Cited

U.S. PATENT DOCUMENTS

| | | | | |
|---|---|---|---|---|
| 3,716,938 | A * | 2/1973 | Ammons | 43/55 |
| 4,580,706 | A * | 4/1986 | Jackson et al. | 224/427 |
| 5,013,290 | A * | 5/1991 | DeMatteis | 493/196 |
| 5,433,358 | A * | 7/1995 | Millard | 224/153 |
| 5,862,967 | A * | 1/1999 | Johnson | 224/577 |
| 5,954,253 | A * | 9/1999 | Swetish | 224/631 |
| 6,135,333 | A * | 10/2000 | Tucker et al. | 224/646 |
| 6,196,437 | B1 * | 3/2001 | Smith, III | 224/629 |
| 7,021,508 | B1 * | 4/2006 | Aston | 224/628 |
| 7,077,303 | B2 * | 7/2006 | Zega | 224/673 |
| 8,006,877 | B2 * | 8/2011 | Lowry et al. | 224/633 |
| 8,196,791 | B2 * | 6/2012 | Hogg | 224/634 |

* cited by examiner

*Primary Examiner* — Brian D Nash
*Assistant Examiner* — Derek Battisti
(74) *Attorney, Agent, or Firm* — Michael F. Krieger; Kirton McConkie

(57) ABSTRACT

A backpack frame is disclosed herein. The backpack frame includes a frame body and an arm coupled to the frame body. The arm has a proximal portion at the one or more points of connection and a distal portion that is extended away from the one or more points of connection. A space between a distal portion of the arm and the frame body is sufficiently sized to receive the head of an antlered animal therethrough when the distal portion of the arm is pivoted away from the frame body. The arm is capable of pivoting at a point of connection between the arm and the frame body. Accordingly, at least in some instances, when the head of an antlered animal is inserted through the space, the arm pivots, locking the head in place and supporting the head and antlers.

17 Claims, 14 Drawing Sheets

BACKPACK FRAME

RELATED APPLICATIONS

This application claims priority to U.S. Provisional Patent Application Ser. No. 61/465,007, filed Mar. 14, 2011, entitled "Rack Pack, Rack Sack."

BACKGROUND

When game hunting, it can be useful to carry a backpack that can hold game meat, pelts, antlers, and other parts acquired during the hunt. Because these objects can be very heavy, the hunter can use a frame backpack to provide support and the ability to distribute the weight of the load on the wearer's body. Framed backpacks include internal and external frame packs. The ability of a backpack to adequately hold the desired objects is important. Many current backpacks fail to provide the ability to pack all of the portions of a game animal that need to be carried. Without these abilities, these objects must be carried in separate bags or by hand.

SUMMARY

The present invention has been developed in response to problems and needs in the art that have not yet been fully resolved by currently available backpacks. Particularly, the present devices and methods that provide a backpack with the capability to supporting all of the portions of a game animal including its head, antlers, and pelt without the need for a large number of straps or ropes to tie down these parts with multiple wrappings.

In one aspect of the invention, a backpack frame includes a frame body and an arm coupled to the frame body. The arm is capable of pivoting at one or more points of connection between the arm and the frame body. The arm has a proximal portion at the one or more points of connection and a distal portion that is extended away from the one or more points of connection. When the distal portion of the arm is pivoted away from the frame body, a space between the distal portion of the arm and the frame body is sufficiently sized to receive the head of an antlered animal therethrough.

Implementations may include one or more of the following features. The arm may be rigid and is pivotally coupled to the body. The distal portion of the arm may include one or more contours that bow upwards in relation to the backpack frame when in use. A bag may be coupled to the arm. The bag may have an opening, and wherein at least a portion of the perimeter of the opening is coupled to the arm. The arm may be shaped to form at least one-half of a loop. The backpack frame may further include a stand coupled to the frame body and an accessory adapter coupled to a top portion of the stand. The accessory adapter may be a tripod table. The backpack frame may further include one or more loops coupled to the arm. The arm may be non-rigid and/or adjustable in length. The arm may be a strap or a rope. The frame body may include two vertical frame members and one or more horizontal frame member coupling the two vertical frame members.

In another aspect, a backpack frame includes a frame body, a stand coupled to the frame body, and an accessory adapter coupled to a top portion of the stand. Implementations may include one or more of the following features. The stand may include an adjustable member that varies the height of the stand. The adjustable member may include a rod disposed within a sleeve and a locking member that locks the rod in place relative to the sleeve. The accessory adaptor may be a tripod table.

In another aspect, a method for attaching the skull of an animal having antlers to a backpack includes providing a backpack frame, providing an arm that is coupled to the backpack frame, and inserting the skull of the antlered animal through the space. The arm is capable of pivoting at a point of connection between the arm and the backpack frame. A space between at least a portion of the arm and the frame body is sufficiently sized to receive the head of an antlered animal therethrough.

Implementations may include one or more of the following features. The method may further comprise securing the skull of the animal to the arm by tying the skull or an antler of the antlered animal to one or more loops coupled to the arm. Inserting the skull of the animal may include inserting the skull of the animal snout-first into the space.

These and other features and advantages of the present invention may be incorporated into certain embodiments of the invention and will become more fully apparent from the following description and appended claims, or may be learned by the practice of the invention as set forth hereinafter. The present invention does not require that all the advantageous features and all the advantages described herein be incorporated into every embodiment of the invention.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. These drawings depict only typical embodiments of the invention and are not therefore to be considered to limit the scope of the invention.

DETAILED DESCRIPTION OF THE INVENTION

The embodiments of the present invention will be best understood by reference to the drawings, wherein like reference numbers indicate identical or functionally similar elements. It will be readily understood that the components of the present invention, as generally described and illustrated in the figures herein, could be arranged and designed in a wide variety of different configurations. Thus, the following more detailed description, as represented in the figures, is not intended to limit the scope of the invention as claimed, but is merely representative of presently preferred embodiments of the invention.

Figure 1:
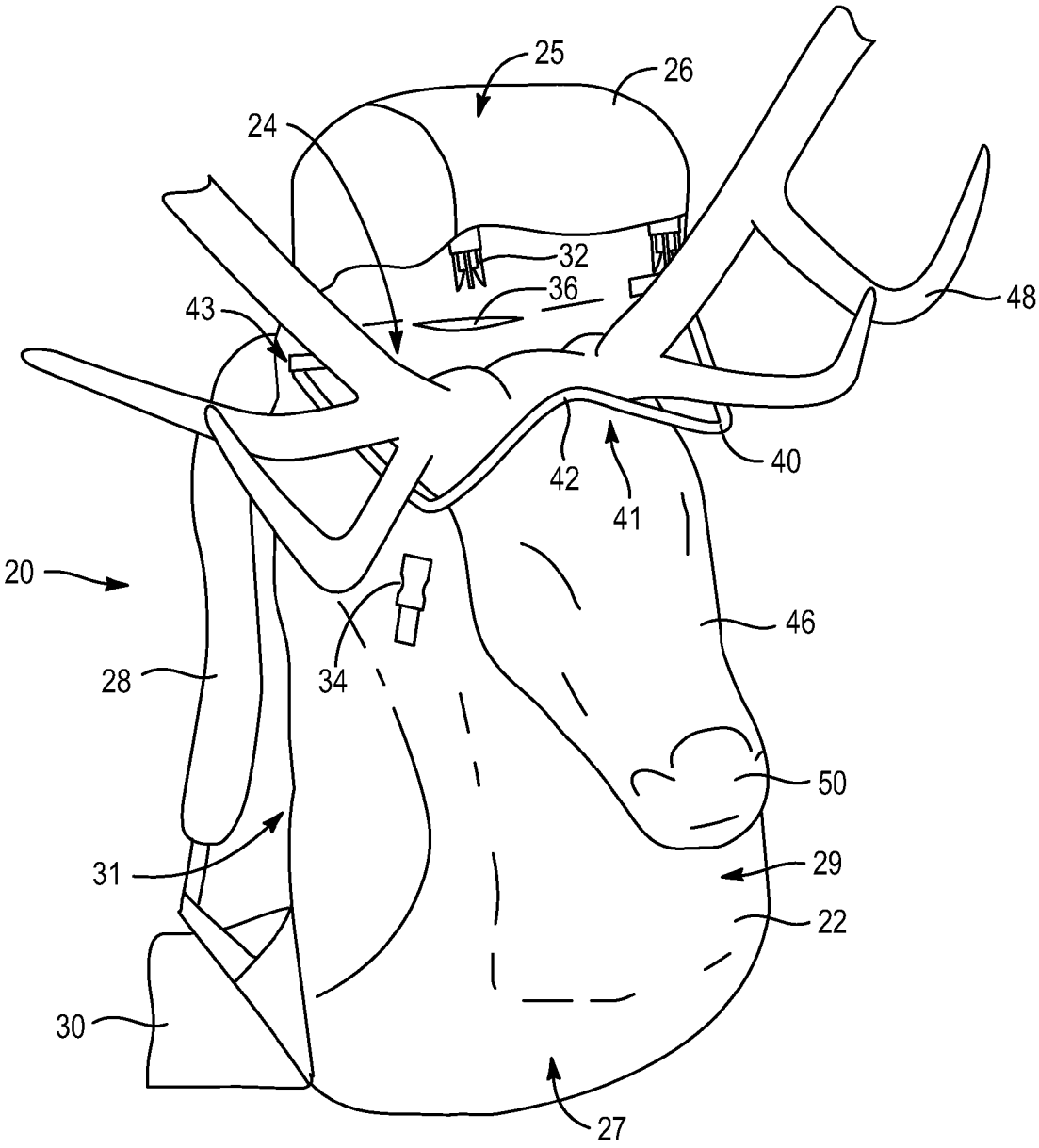
FIG. 1 is a perspective view of a backpack frame having an arm. The backpack frame is disposed within a backpack and the arm is supporting the head and antlers of an animal, according to some embodiments.

The present invention relates to devices and methods that provide a backpack with the capability of supporting an animal head, antlers, and pelt without the need for a large number of straps or ropes to tie down these parts with multiple wrappings. FIG. 1 illustrates a representative backpack system 20, according to some embodiments, having these carrying capabilities. As shown, the backpack 22 comprises a frame that includes a frame body (shown in FIG. 2 as element 60) and an arm 40 that is coupled to the frame body. The arm may be used to support the head 46 and antlers 48 of an antlered animal, as illustrated. As shown, the backpack 22 is an internal frame backpack, however, the backpack 22 can also be an external frame backpack, such as the backpack shown in FIG. 9. In some configurations, the backpack system 20 is capable of packing the head 46, antlers 48, pelt, and/or other portions of a game animal, as at least partially shown in FIG. 1.

When hunting, a hunter may carry gear and supplies within a backpack 22. Such a backpack 22 can have one or more internal pockets or compartments 24. The backpack 22 can include a top hood 26 that covers the top of the backpack 22 and is locked down by one or more sets of connectors 32, 34. The top hood 26 or other internal compartment 24 can include one or more slit openings 36 through which various objects can be inserted or extended, such as that shown in FIG. 7. The backpack 22 can be strapped to a wearer with shoulder straps 28 and/or a waist strap 30 that extends from the back 31 of the backpack 22 to distribute the weight of the pack on the wearer. In some configurations a backpack 22 can include additional straps, pockets, and other components that are not shown in FIG. 1, but which can assist to secure gear and supplies to the backpack 22. As used herein, the top 25 and bottom 27 of the backpack 22 refer to the top and bottom 25 of the backpack 22 when in use, as illustrated. Also, the front 29 and back 31 of the backpack 22 are labeled, the back 31 being the side that contacts a wearer's back, the front 29 being farthest from the wearer when in use.

When a game animal is killed during a hunt, the hunter has the task of carrying at least some portion of the animal to a location where it can be processed. If the game animal is heavy it may be parted so that it can be carried by multiple people. Occasionally, the animal must be carried a large distance. Because the head 46 of an animal, and especially the antlers 48, are used as display or ornamental objects, it can be desirable to leave the head (or at least the skull) and the antlers intact. The pelt can also be used as a display or ornamental object alone or while still intact with the head 46 and antlers 48. Accordingly, in some instances, the head 46, antlers 48, and pelt (not shown) of an animal must be left intact and must be packed for many miles, as can be accomplished with the present backpack system 20.

In some embodiments, an antlered animal (an animal with antlers) can be carried with the arm 40 of the backpack frame. Accordingly, a hunter can insert the head 46 of the animal through the arm 40. The head 46 can be inserted snout (50)-first through the arm 40 until the antlers 48 contact the arm 40. At this point, the head 46 is lowered to a resting position where the combined force of the head 46 and antlers 48 on the arm 40 presses down on the head 46, locking it in place.

Figure 2:
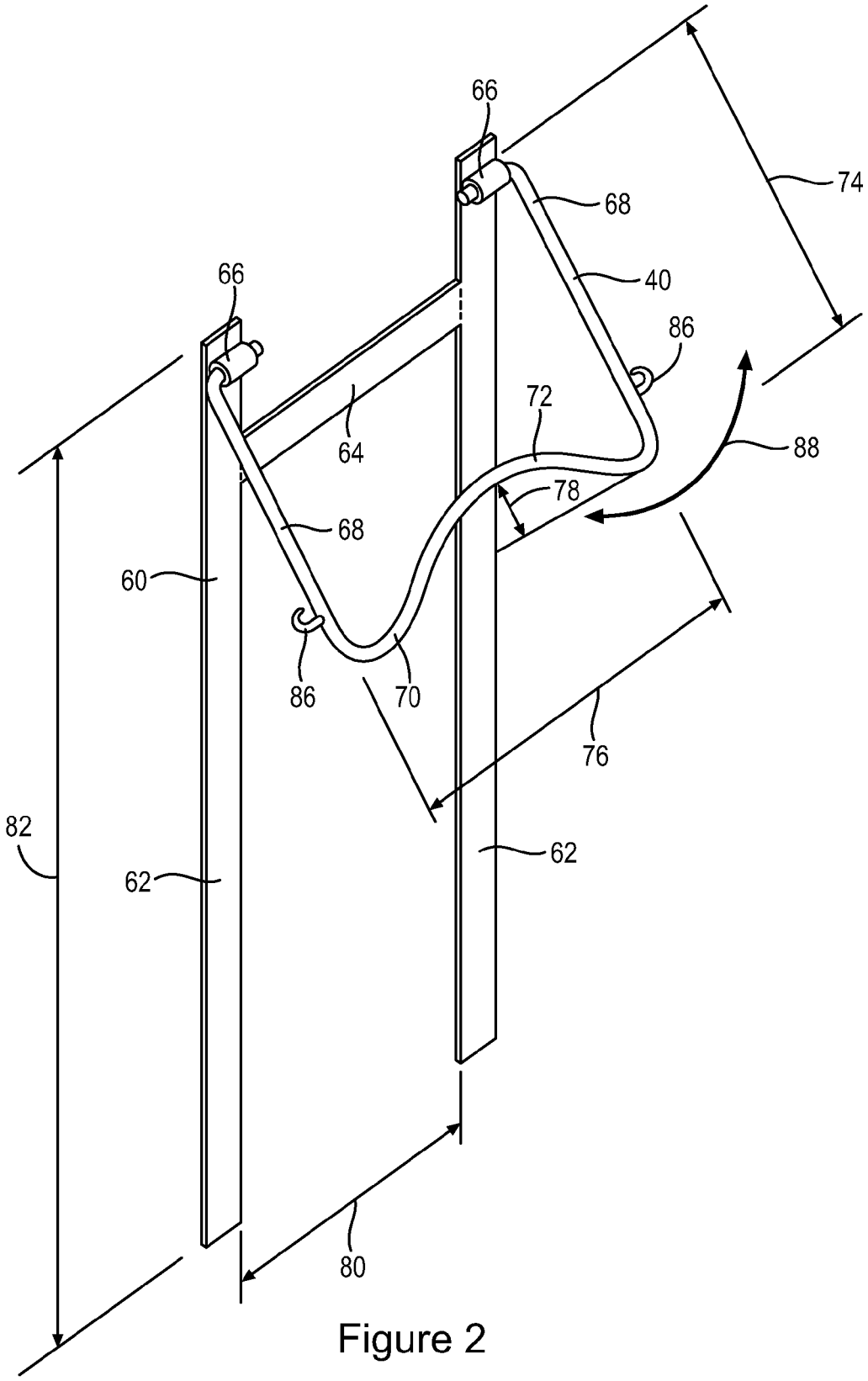
FIG. 2 is a perspective view of a backpack frame having an arm, according to some embodiments.

In some instances, the arm 40 includes a proximal portion 43 and a distal portion 41. The proximal portion 43 is the end portion or end portions of the arm 40 that contact the frame body 60. As shown in FIG. 2, the proximal portion 43 includes the two ends of the arm 40 that connects to the frame body 60. In instances where the arm 40 is connected to the frame body 60 at a single point of connection, this single portion about the connection is the proximal portion 43. The distal portion 41 is the portion of the arm 40 that is extended away from the one or more points of connection between the arm 40 and the frame body 60. In some instances, the arm 40 can be distinguished by designating a distal half and a proximal half, these halves corresponding to the portions of the arm 40 that is disposed within the first and second halves of the distance between the frame body 60 and the farthest point to which the arm 40 extends away from the point(s) of connection with the frame body 60.

In some configurations, the distal portion 41 of the arm 40 includes one or more contours 42. In some configurations, the one or more contours 42 at least partially or substantially conform to the natural curve of the animal's head 46. In some configurations, the one or more contours 42 natural outward orientations of the antlers 48 to further enable the locking ability of the arm 40. In some instances, the one or more contours 42 are located opposite the frame, the portion of the arm 40 farthest from the frame. In some embodiment, the one or more contours 42 bow upwards, as shown in FIGS. 1 and 2. In some embodiments, the one or more contours 42 deviate from the general plane of the arm 40, which is the plane in which the arm 40 extends away from the frame. In some instances, this height of this deviation is about 20 to 75 percent of the maximum opening width (for example, the distance 76 between the extension portions 68 of FIG. 2) of the arm 40 In other instances, this height is approximately 30 to 60 percent of the maximum opening width of the arm 40. In other instances, this height is approximately 35 to 50 percent of the maximum opening width of the arm 40.

Various different configurations of arms 40 can be useful to support, lock-in, and pack the head of an animal having antlers 48. Because the size of antlered animals varies, the shapes and sizes for the arm 40 can vary based on which animal the hunter is hunting. For example, while deer, reindeer, moose, elk, caribou, antelope, and gazelle each have antlers (antlers being branching bony appendages on the heads of animals), they have different head sizes and shapes as well as different antler placements and orientations. Accordingly, the shape of the arm 40 can vary to accommodate the specific game animals approximate head shape and size. Non-limiting examples of alternative shapes are depicted in FIGS. 10 to 13. Accordingly, the dimensions of the arm 40, which are illustrated in FIG. 2, can vary to accommodate different antlered animals. For example, in some configurations, the arm 40 extends out from the frame body 60 a distance 74 between about 6 to 20 inches. In other configurations, this distance 74 is between about 7 to 14 inches. In other configurations, this distance 74 is between about 8 to 10 inches. Additionally, in some configurations, the arm 40 has a maximum opening width 76 of about 6 to 18 inches. In other configurations, the arm 40 has a maximum opening width 76 of between about 7 to 14 inches. In other configurations, the arm 40 has a maximum opening width 76 of between about 8 to 10 inches.

Figure 5:
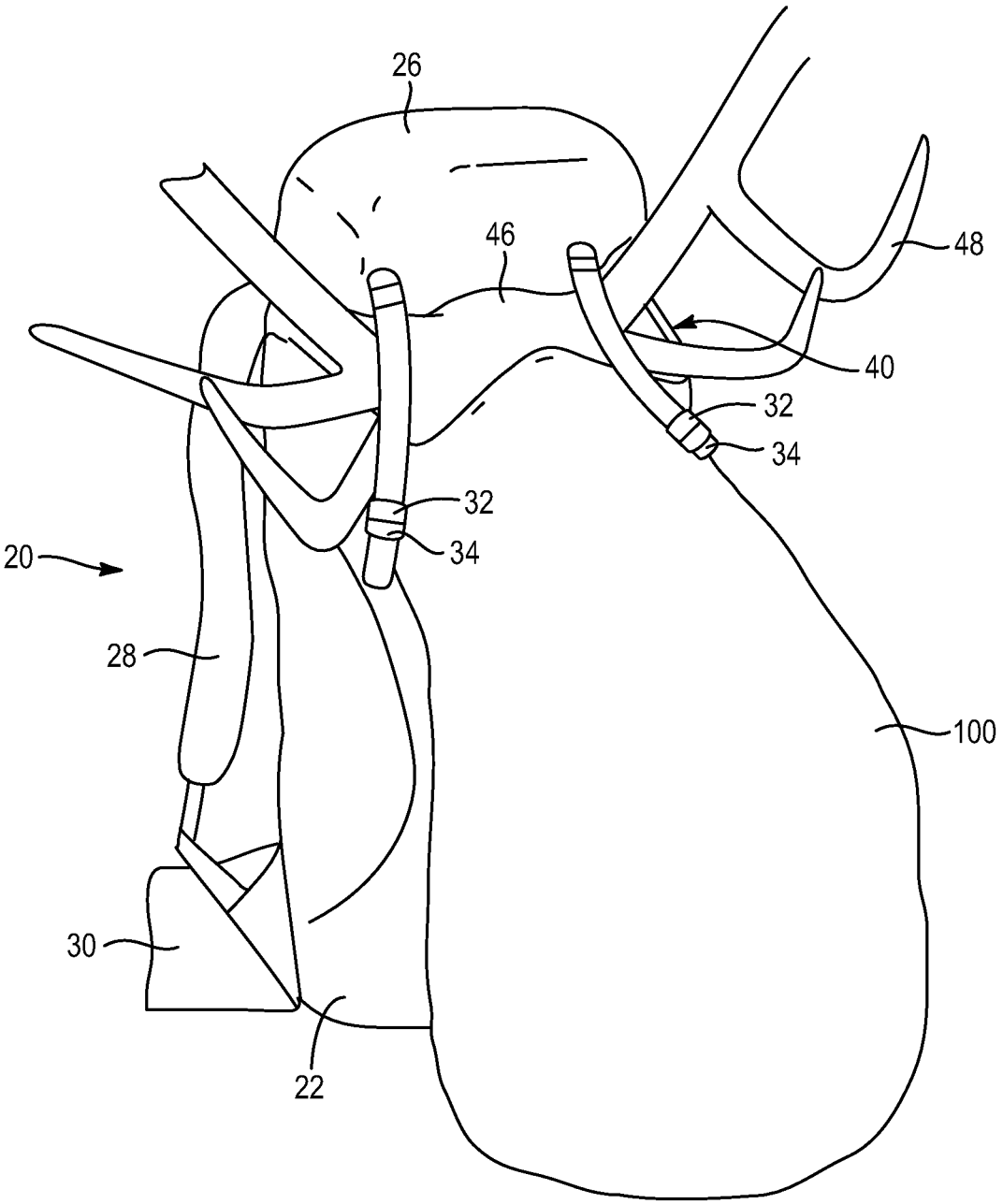
FIG. 5 is a perspective view of a backpack frame having an arm. The backpack frame is disposed with in a backpack and the arm is supporting the head and antlers of an animal. The head and pelt of the animal is inserted into a bag connected to the arm, according to some embodiments.

Referring again to FIG. 1, in addition to carrying the head 46, the animal's pelt can be carried by the backpack 22. This can be useful when the hunter wants the pelt and head 46 to remain intact. In some embodiments, the pelt (not shown) can be inserted into an internal compartment 24 of the backpack 22. For example, as shown in FIG. 1, the pelt can be inserted into an upward or frontward-opening, top compartment that is at least approximately adjacent to the arm 40. Once the pelt is at least mostly inserted into the compartment, the head 46 can be inserted through the arm 40, as previously described. In other embodiments, the pelt can be carried in a separate bag that is connected to and hangs from the arm 40, as shown in FIG. 5.

More specific reference will now be made to FIG. 2, which illustrates a perspective view of a frame body 60 that has an arm 40. As depicted, in some embodiments, the frame body 60 is designed to be inserted in to an internal frame backpack, such as that shown in FIG. 1. In some configurations, the frame body 60 includes two vertical portions 62 and a horizontal portion 64. In other configurations, the frame body 60 has other configurations and variations that are herein anticipated. For example, in some configurations, the frame body 60 includes a single plate having contours that approximate the shape of the wearer's back.

Regarding, for example, the configuration of the frame body 60 illustrated in FIG. 2, the horizontal and vertical portions 62, 64 of the frame can have various lengths 82, widths, and thicknesses to conform to the shape and size of backpack 22 into which the frame body 60 is inserted. For example, in some instances, the length 82 of the vertical portions 62 is between about 8 to 30 inches. In other instances, the length 82 is of the vertical portions 62 is between about 12 to 20 inches. In other instances of the vertical portions 62 is between about 16 to 19 inches. Additionally, length 80 of the horizontal portions 64 can be between about 5 to 14 inches. Alternatively, the length 80 of the horizontal portions 64 can be between about 6 to 10 inches. Or, the length 80 of the horizontal portions 64 can be between about 7 to 9 inches. These vertical portions 62 and horizontal portions 64 can have various widths, such as about between about ½ to 2 inches, and various thicknesses such as between about 1/16 to ½ inches. The width and thickness and of these portions 62, 64 can also vary based on the material used to form the frame.

Figure 3:
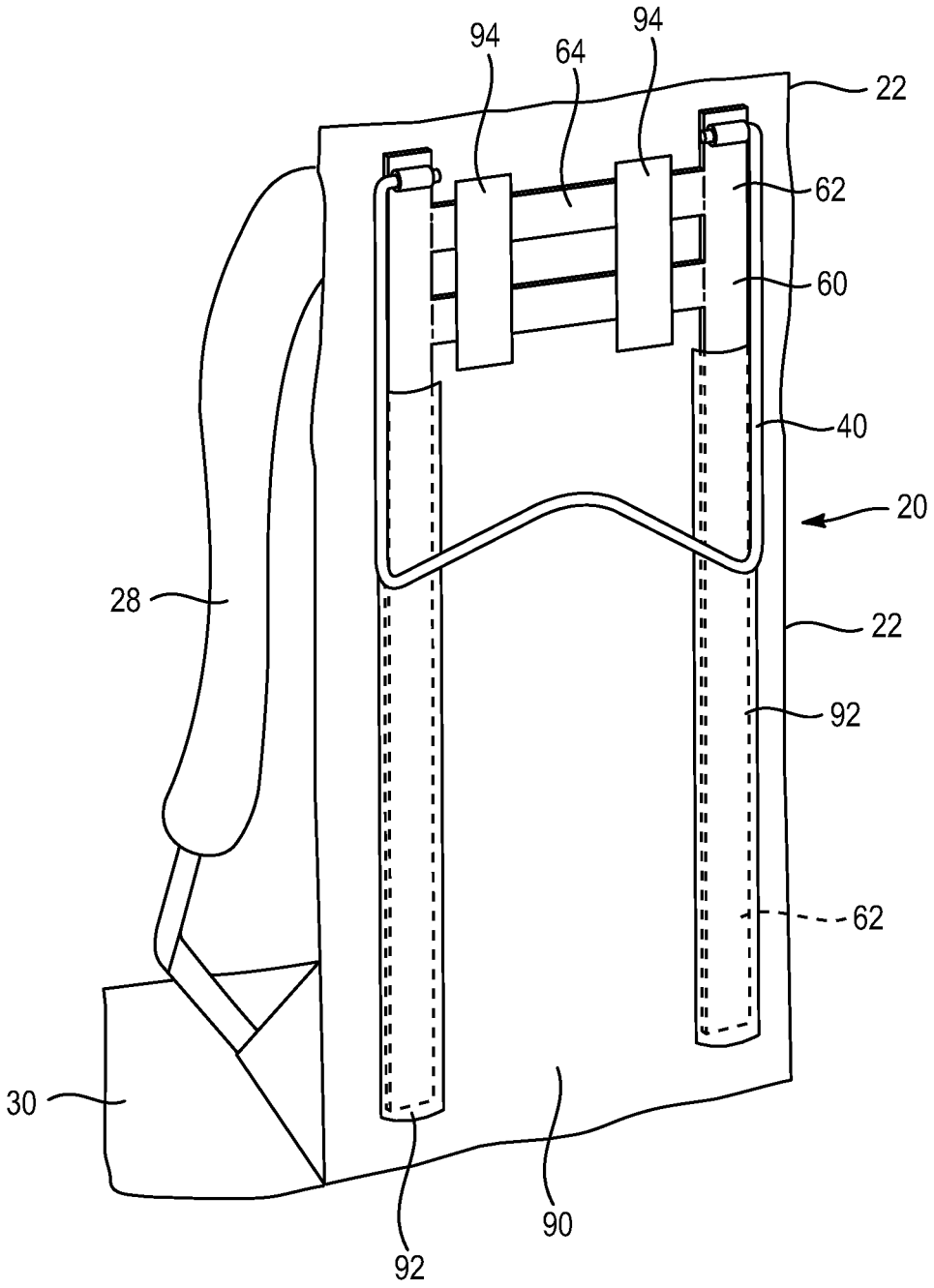
FIG. 3 is a perspective view of the back panel of a backpack having a frame disposed therein, according to some embodiments.
Figure 4:
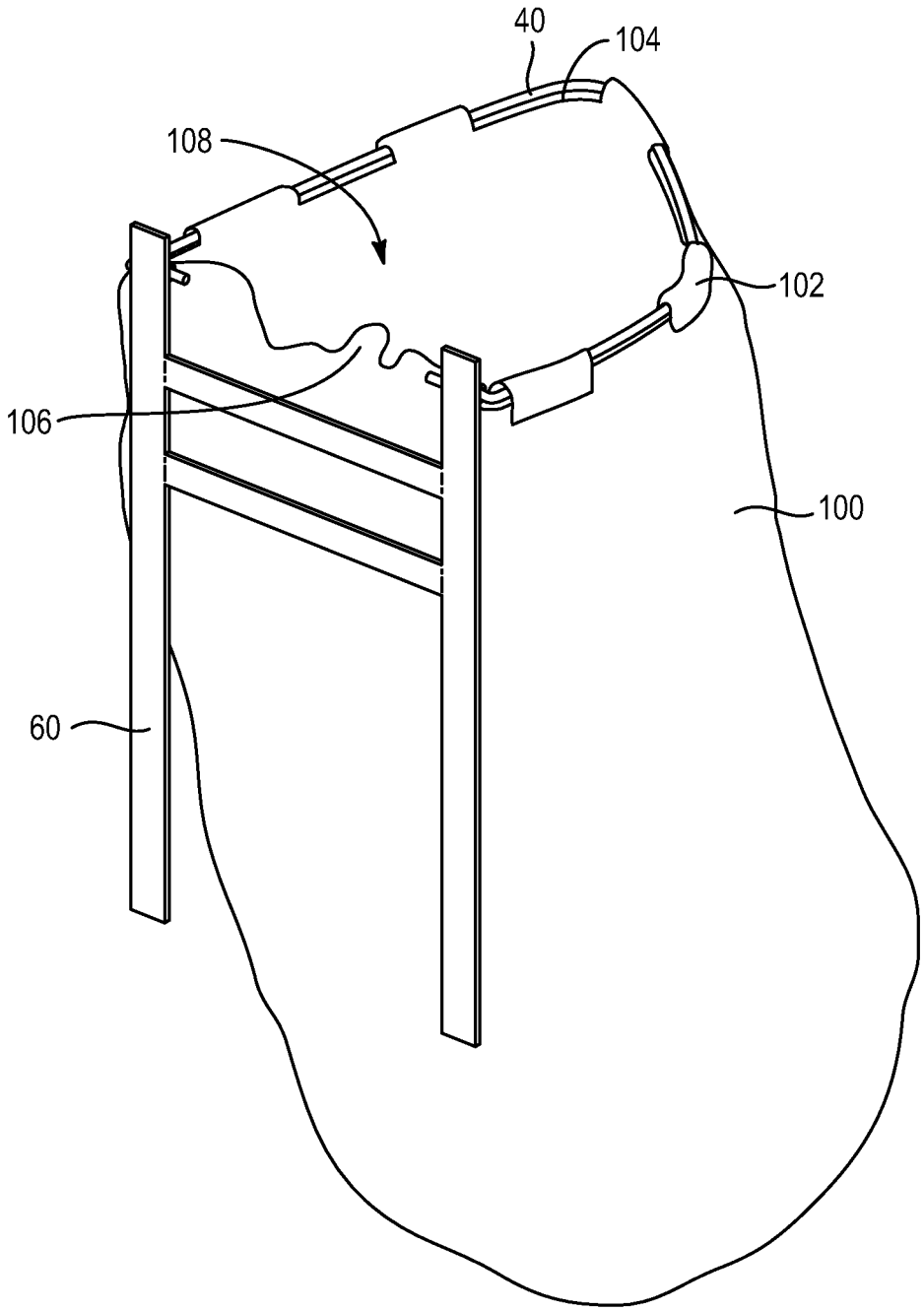
FIG. 4 is a perspective view of a backpack frame having an arm and a bag connected to the arm, according to some embodiments.
Figure 11:
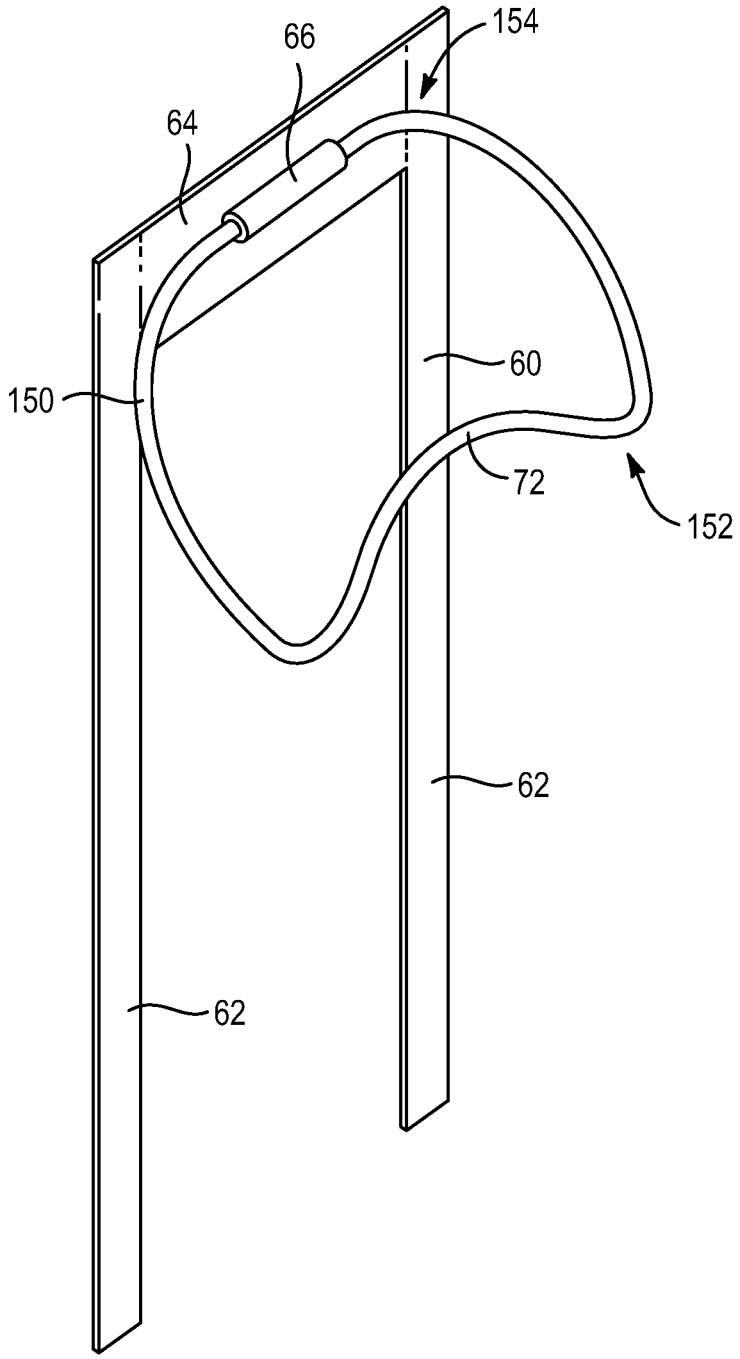
FIG. 11 is a perspective view of a backpack frame having another arm, according to some embodiments.

The frame body 60 can be made of various materials and have various shapes and configurations. For example, the frame body 60 can be made entirely or partially of aluminum, steel, stainless steel, or another metal, metal alloy, etc. These materials can be welded together or cast as a single unit. Additionally, the frame body 60 can be made entirely or partially of a plastic or a composite material which can provide the frame body 60 with sufficient structural strength. In some embodiments, the frame body 60 is at least partially bendable, such that it can be bent to conform to the curve of the wearer's back. In some embodiments, the frame body 60 has pre-made contours to conform to the wearer's back. In some configurations, the frame body 60 has other configurations that that shown in FIG. 2. For example, in some instance, the frame body 60 can have two horizontal portions 64, as shown in FIGS. 3 and 4. In some instance, the frame body 60 can also have a horizontal portion 64 disposed on the top end of the vertical portions 62, as shown in FIG. 11. In some instances, frame body 60 can include one or more horizontal portions 64 connecting the vertical portions 62 at their bottom portions or in the middle. Other such variations in the frame's configuration can be incorporated, in some embodiments.

As also shown in FIG. 2, the arm 40 can pivot with respect to one or more connections points with the frame body 60 in the direction marked as 88. In some embodiments, the ability to pivot enables the arm 40 to be stowed within the backpack 22 when not in use, and be moved to a more horizontal position when in use. In some embodiments, the ability to pivot enables to weight of the head 46 and antlers 48 to naturally move the arm 40 to a position in which the head 46 and antlers 48 are at least mostly locked in place. In some configurations, one or more loops, hooks, holes, etc. 86 (herein "loops" refers to loops, hooks, holes and other equivalent structures) can be coupled to the arm 40 or frame body 60 to which ropes or straps can be attached to further secure the head 46 and antlers 48 in place.

In some configurations, as shown, the arm 40 is rigid, being made of a rigid material, such as those rigid material listed above from which can be made the frame body 60. In some instances, this rigidity enables the arm 40 to move as a unit about the one or more points of connection between the arm 40 and the frame body 60 without excessive flexing. As the arm 40 moves, the weight of the animal's head 46 and antlers 48 can force the arm 40 downward as a unit, locking the animal's head 46 and antlers 48 in place. In some embodiments, the arm 40 is pivotally coupled to the top portion of the frame body 60 with connectors 66. Various types of connectors 66 can be used to couple the arm 40 to the frame body 60. In a non-limiting example, as shown, the connector 66 includes a tube through which the arm 40 extends and in which the arm 40 pivots. The length and configuration of the arm 40 retains it within the tube.

Reference will now be made to FIG. 3, which depicts a perspective view of the backpack system 20 with the backpack compartments and top hood removed, leaving the back panel 90 exposed. In some configurations, the back panel 90 is attached to the shoulder strap 28 and the waist strap 30. The back panel 90 can have one or more pockets 92 into which the vertical portions 62 of the frame body 60 are inserted and retained. Additionally or alternatively, the back panel 90 can have one or more straps 94 that selectively secure the horizontal portions 64 of the frame body 60 to the back panel 90. In other instances, the back panel 90 can have other configurations of features that likewise secure the frame body 60 to the back panel 90. As shown, the arm 40 is moved to a downward, storable position, as described above.

FIG. 4 illustrates another feature that can be included with the frame body 60 and arm 40, according to some embodiments. This feature is a bag 100 into which the head and pelt of an animal can be inserted. This bag 100 can both contain these items and keep the rest of the backpack clean, away from the blood on the pelt and head. During use, the bag can be put inside a compartment of the backpack 22 or be disposed outside of the backpack compartments. The bag 100 can be permanently or temporarily fixed to the arm 40 or the frame body 60 via a number of different means. In some instances, the opening 108 of the bag 100 has an outer perimeter that is connected, in part of in whole, to the frame body 60 and/or the arm 40. For example, in some configurations, portions 102 of the perimeter of the opening 108 are loop over the supporting member and secured to the main body of the bag 100. The loop portions 102 of the bag 100 are separated by non-connecting portions 104. In some configurations, the perimeter of the opening 108 is greater than the external surface of the space between the arm 40 and the frame body 60 into which the animal's head is inserted. Accordingly, in such configurations, as illustrated, the opening 108 includes extra material 106 that permits the bag to be threaded onto and off of the arm 40 and moved to a single side of the arm 40. In other configurations, the perimeter of the opening 108 is approximately equal to the external surface of the space between the arm 40 and the frame body 60 into which the animal's head is inserted. In some embodiments, the bag 100 is only connected to the arm 40.

FIG. 5 illustrates the bag 100 of FIG. 4 in use with a backpack system 20 outside of the backpack 22. As can be seen, in some embodiments, the bag 100 provides additional carrying capacity to the backpack system 20. Accordingly, in some instances, the bag 100 can be used to allow the wearer to keep his gear and supplies within the main compartments 24 of the backpack 22, while carrying the head and pelt of the animal within the bag 100. In some embodiments, the bag 100 can be strapped to the backpack 20 at one or more locations with a strap, ropes, or other such strapping means (not shown) to secure the bag to the backpack 22.

Thus, as will be understood from the foregoing, the backpack system 20 provides a backpack and frame that are capable of supporting the head, antlers, and/or pelt of a game animal without the need for a large number of straps or ropes to tie down these parts with multiple wrappings. Embodiments of the backpack system 20 can provide hunters with the ability to keep their packs clean and to have the capacity for pelts to be stored an attached bag 100 rather than within the backpack or in separate bags. In some embodiments, each of these components can be used quickly and efficiently, eliminating the time that would otherwise be required to pack and tie down the animal.

Figure 6:
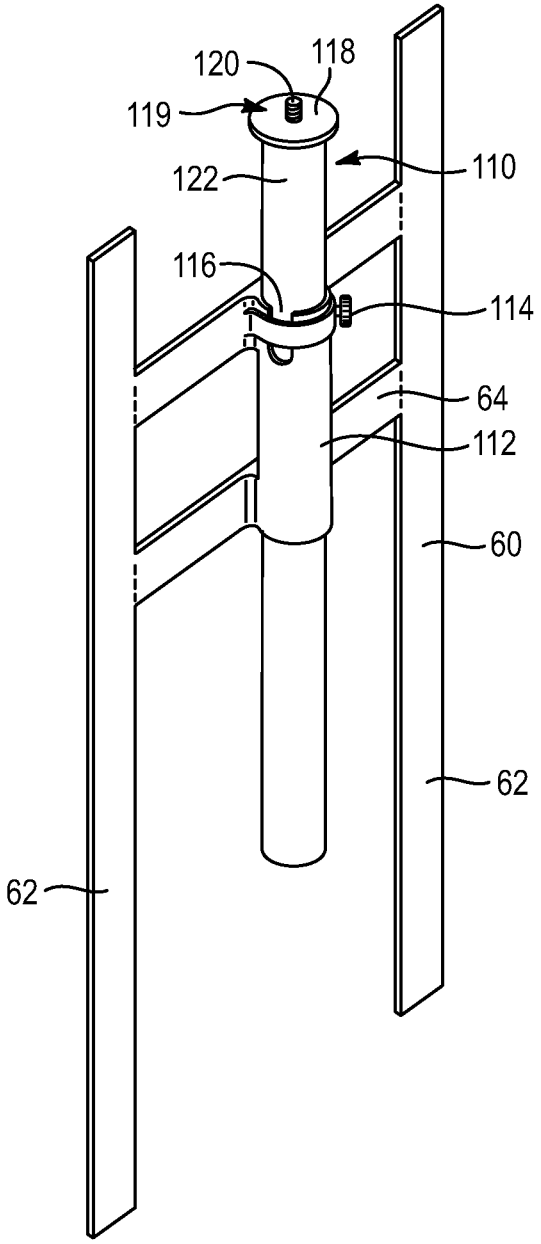
FIG. 6 is a perspective view of a backpack frame having a stand with an accessory adapter, according to some embodiments.

FIG. 6 depicts another aspect of the backpacking system 20 that includes a stand 110 that can support an accessory, such as binoculars, a spotting scope, a camera, or other such accessory. Hunters use scopes or even cameras to view objects and animals located far away. When an animal can be seen at a distance, the hunter has the advantage of possible seeing the animal before the animal detects the hunter. The steadier the scope or camera can be held the farther a hunter can see clearly. Thus, some hunters, hikers, and backpackers may carry tripods with them that enable them to hold a scope or camera very steady and see very far. However, it is not always feasible to pack a tripod along with all of the other gear that a person is carrying, particularly when traveling long distances or traveling for many days. Accordingly, a very light-weight, low volume scope stand 110 that is connected to the frame body 60 of a backpack 22 can be beneficial to support and/or steady an accessory.

In some embodiments, the stand 110 is coupled to one or more portions of the frame body 60, such as the vertical 62 or horizontal 64 portions. In some embodiments, the stand 110 is coupled to one or more horizontal portions 64 that support the stand 110. The dimensions of the portions of the frame body 60 that supports the stand 100 can be customized to provide support to the frame body 60, the backpack 22, and the stand 110, without adding substantially more weight to the backpack system 20.

In some embodiments, the stand 100 includes one or more adjustable members that are configured to vary the length of the stand 110. In some configurations, the one or more adjustable members include a rod 122 and a sleeve 112. The rod 122 can be selectively disposed within the sleeve 112. In some instances, the rod 122 is raised and lowered by adjusting its position in relation to a static sleeve 112 that is coupled to the frame body 60. The outer dimensions of the rod 122 can be approximately the same as the inner dimensions of the sleeve 112. The rod 122 may selectively travel within the sleeve 112 until a locking member 114 locks the rod 122 in position. In some configurations, as shown, the locking member 114 compresses the sleeve 112, which includes a cut-out 116, in order to hold the rod 122 in position via the pressure of the locking member 114. In other configurations, the locking member 114 includes a pin (not shown) that is inserted through the sleeve 112 and the rod 122 to lock the sleeve 112 in position within the rod 122. Other known locking members for locking a rod 122 within a sleeve 112 are anticipated within the scope of the present stand 110. In other embodiments, adjustable member includes a telescoping feature which expanded and retracted in order to extend out of the backpack 22. Other known types of adjustable members are also anticipated within the scope of the present stand 110.

In the illustrated embodiments of FIG. 6, the length of the rod 122 can be varied to accommodate for the backpack's size and the weight requirements of the hunter. A longer rod 122 will be able to be extended to greater lengths, while a shorter rod 122 will not be as versatile. Accordingly in some instances, the rod 122 has a length between about 6 to 36 inches. In other instances, the rod 122 has a length between about 8 to 24 inches. And in other instances, the rod 122 has a length between about 1 to 18 inches. To limit the weight of the rod 122, in some configurations, the rod 122 is made of a lightweight material, for example, the rod 122 can be made entirely or partially of aluminum or another metal or metal alloy, etc. Additionally, the rod 122 can be made entirely or partially of a plastic or a composite material which can provide the stand 110 with sufficient structural strength.

An accessory adapter 119 can be included on the top of the stand 110 so that an accessory, such as binoculars, a spotting scope, or a camera can be selectively attached to the stand 110. The accessory adapter 119 can have the necessary features needed to connect to a scope. Because there are various types of devices used to connect to a scope the accessory adapter 119 can have a variety of configurations. In some configurations, the accessory adapter 119 includes a tripod table 118 that has a screw 120.

Figure 7:
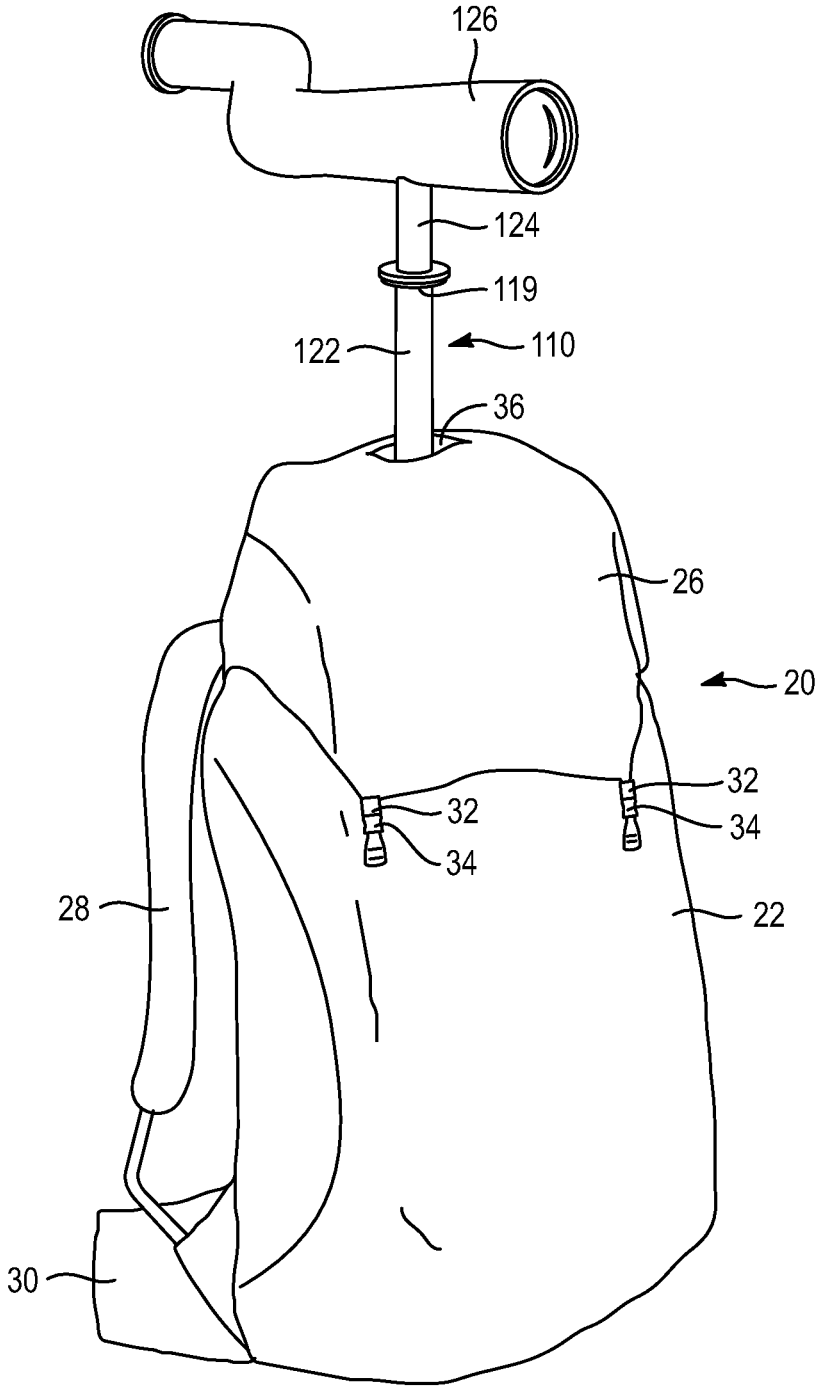
FIG. 7 is a perspective view of a backpack having a stand with an accessory adapter extending from the top of the backpack and a scope coupled thereto, according to some embodiments.

Reference will now be made to FIG. 7, which illustrates a stand 110 extending out of a slit opening 36 in the hood 26 of a backpack 22. The stand 110 is connected to a spotting scope 126 that is supported by a scope connector 124. As shown, in some configurations of the backpack system 20, the backpack 22 can be used to increase the height of the stand 110 and can also be used to provide stability to the stand 110. Accordingly, in a representative instance, the stand 110 can be used as follows. A hunter, hiker, or other individual carrying the backpack system 20 can remove the backpack 22 and place it on the ground or on another object. The stand 110 can be extended from the backpack 22 and the locked at a certain height. A spotting scope 126 can be attached to the accessory adapter 119. Next, while steadying the stand 110, the backpack 22, or both, the hunter can look through the scope to spot game. The hunter can steady the backpack 22 by balancing its internal contents, using external supports, by placing the backpack 22 between his legs while in a seated position, or by otherwise holding the backpack 22. Accordingly, it will be understood that the stand 110 can provide a hunter with a lightweight, low volume, effective method of carrying and supporting a spotting scope 126.

Figure 8:
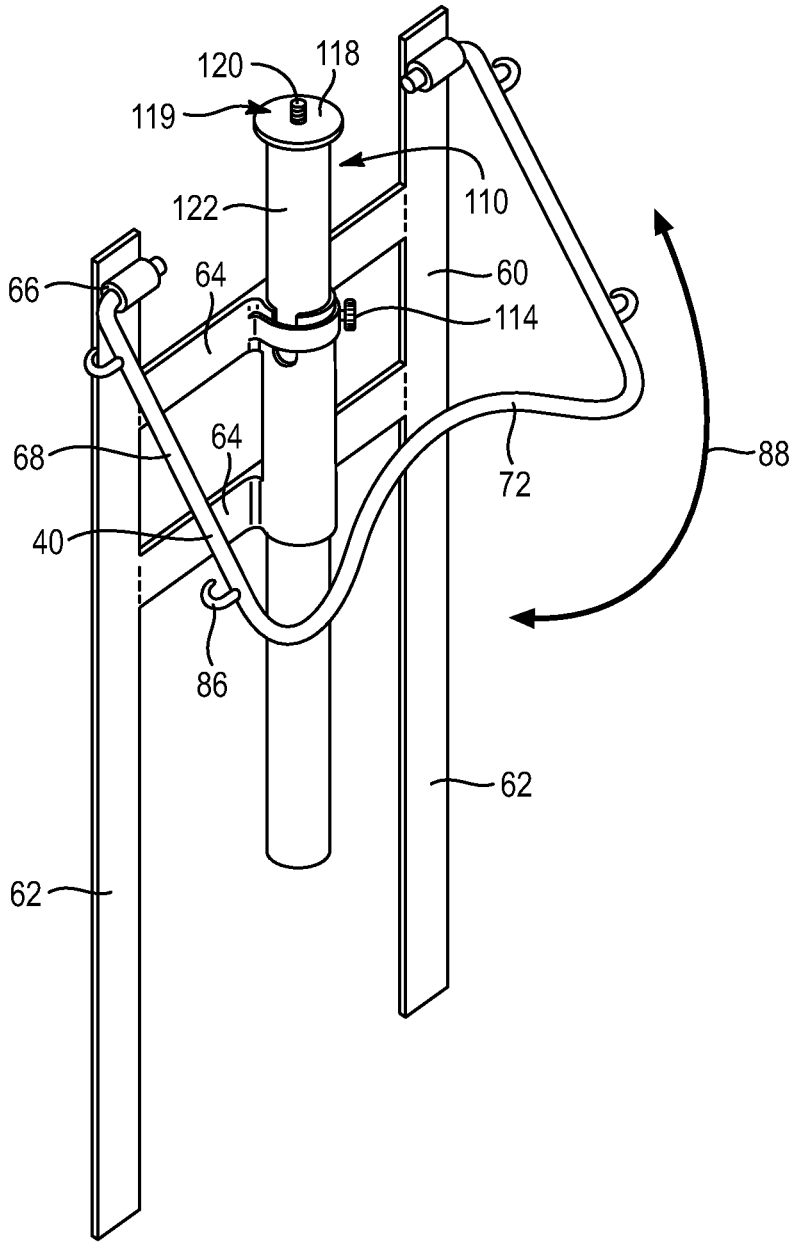
FIG. 8 is a perspective view of a backpack frame having an arm and a stand, according to some embodiments.

FIG. 8 illustrates a frame body 60 having both an arm 40 and a stand 110, according to some embodiments. This device can be used by hunters who desire the ability to have a lightweight stand 110 and an arm 40 that can support an antlered animal.

Figure 9:
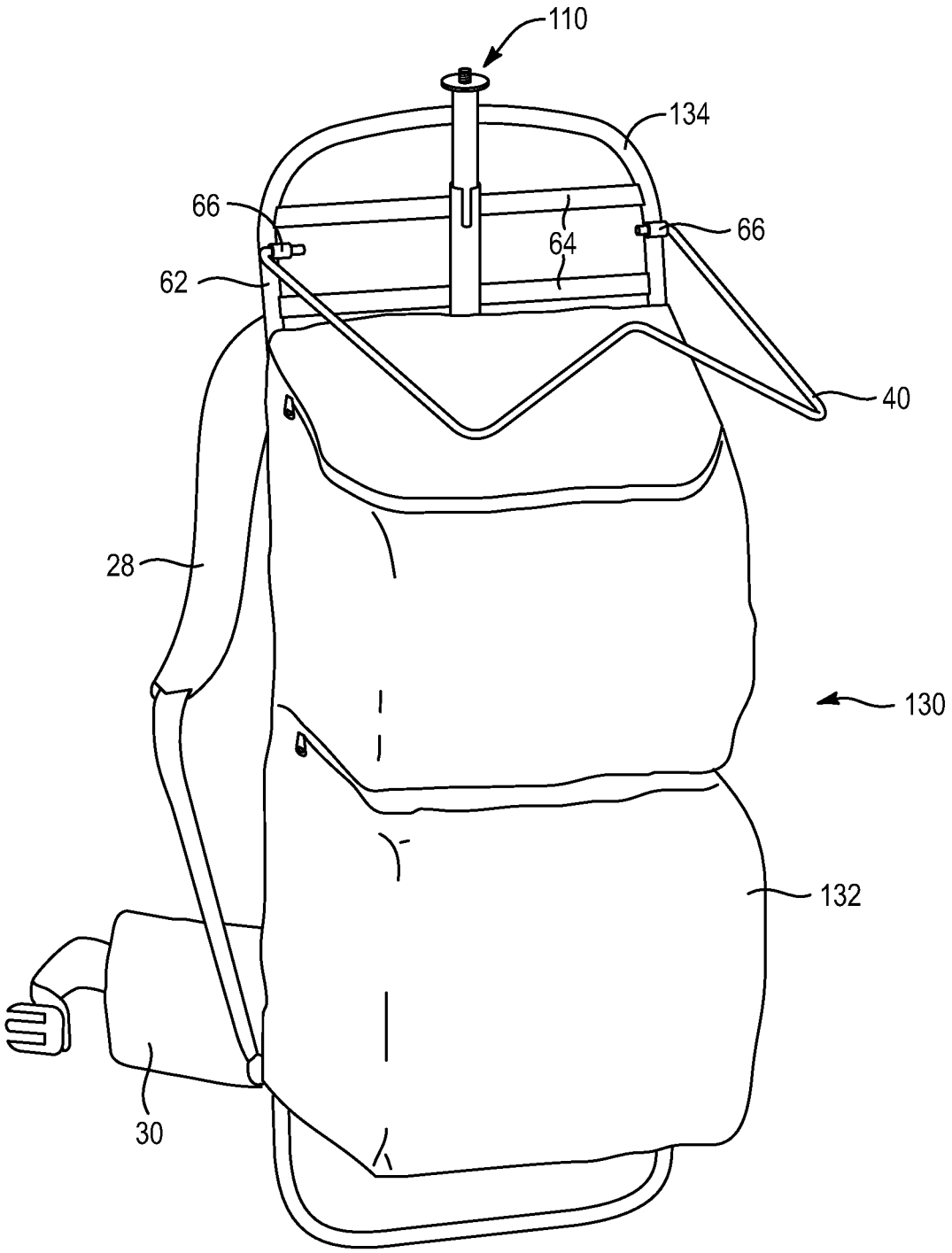
FIG. 9 is a perspective view of an external frame backpack having an arm and a stand, according to some embodiments.

FIG. 9 illustrates a stand 110 and an arm 40 incorporated to the frame 134 of an external frame backpack 132, rather than an internal frame backpack, according to some embodiment. External frame backpacks 132 attach bags or other compartments 24 to the frame 134 rather than inserting the frame 134 within the backpack 22, as with internal frame backpacks. Accordingly, the arm 40 can be coupled directly to the frame 134 at a variety of location on the frame 134, such as near the top, between two compartments, or near the bottom.

Figure 10:
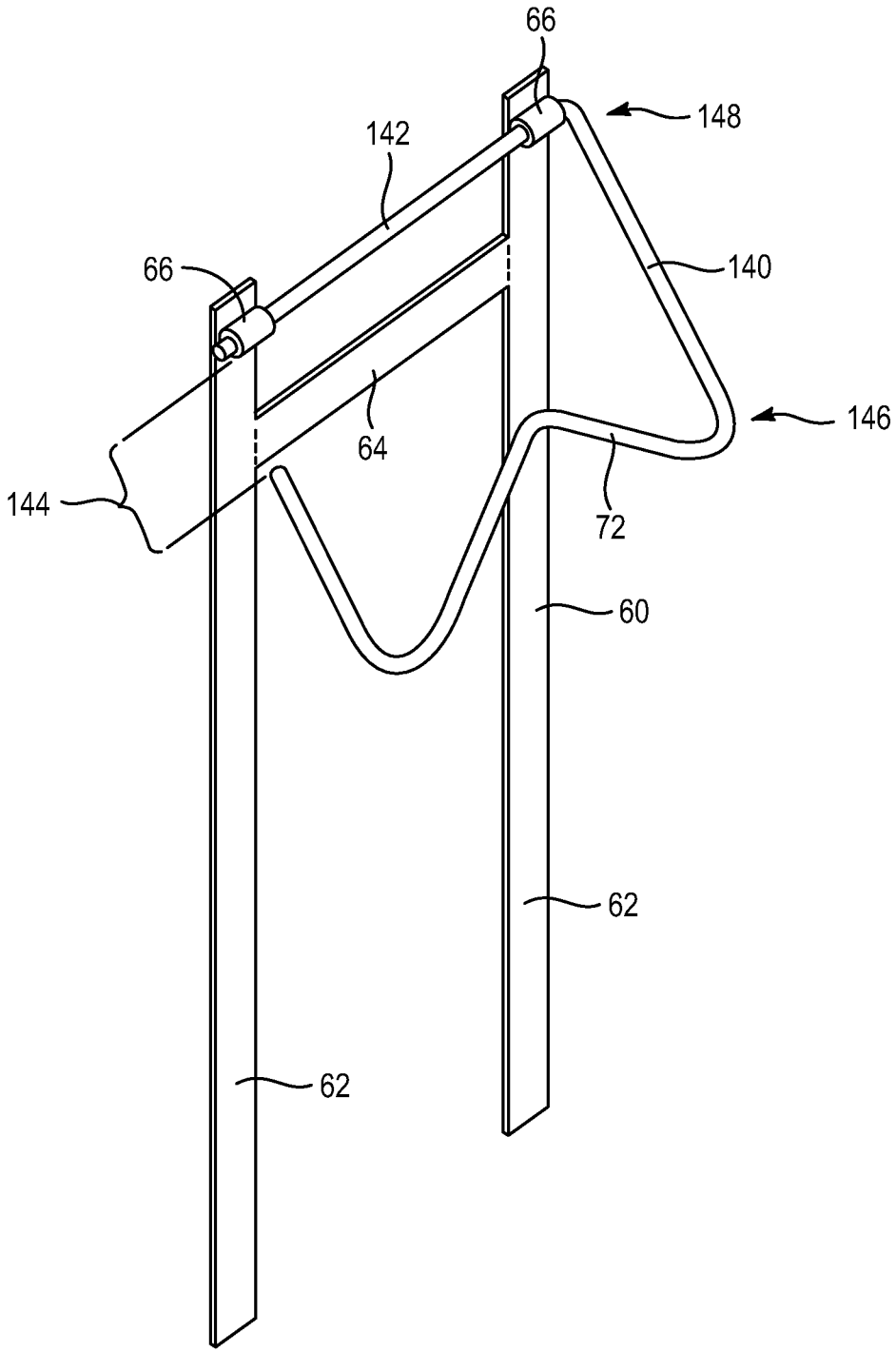
FIG. 10 is a perspective view of a backpack frame having another arm, according to some embodiments.

FIGS. 10 to 13 will now be described. These figures depict alternative embodiments of the arm 40. FIG. 10 depicts an arm 140 coupled to the frame body 60 at two points of connection. As shown, in some embodiments, the arm 140 nearly forms a complete loop, with the exception of a narrow gap 144 between the ends of the arm 140. In other embodiments, the arm 140 can extend farther to form a complete loop. Within this nearly-complete loop, a space exists between a distal portion 146 of the arm 140 the frame body 60 into which an animal's head can be inserted and carried. As the head is inserted into this space and allowed to rest, the weight of the head locks the head and antlers in place, as explained above. The arm 140 differs from that of FIG. 2, in that the proximal portion 148 of the arm 140 extends between the two connectors 60 and then only extends distally from a single side. In some configurations, as shown, the arm 140 also includes one or more contours 72, similar to that of FIG. 2. While the arm 140 is illustrated as being substantially square-shaped, it can have a variety of other shapes and configurations.

FIG. 11 depicts another embodiment of an arm 150 that forms a complete loop. In some embodiments, the proximal portion 154 of the arm 150 is pivotally coupled to the frame with a single connector 66, at a single point of connection. The arm 150 is rounded and forms a space between the frame body 60 and the distal portion 152 of the arm 150 into which an animal's head can be inserted and carried. While the arm 150 is illustrated as being rounded, it can have a variety of other shapes and configurations. In some embodiments, the arm 150 is forms a more square loop. In some configurations, as shown, the arm 150 also includes a contoured portion 72.

Figure 12:
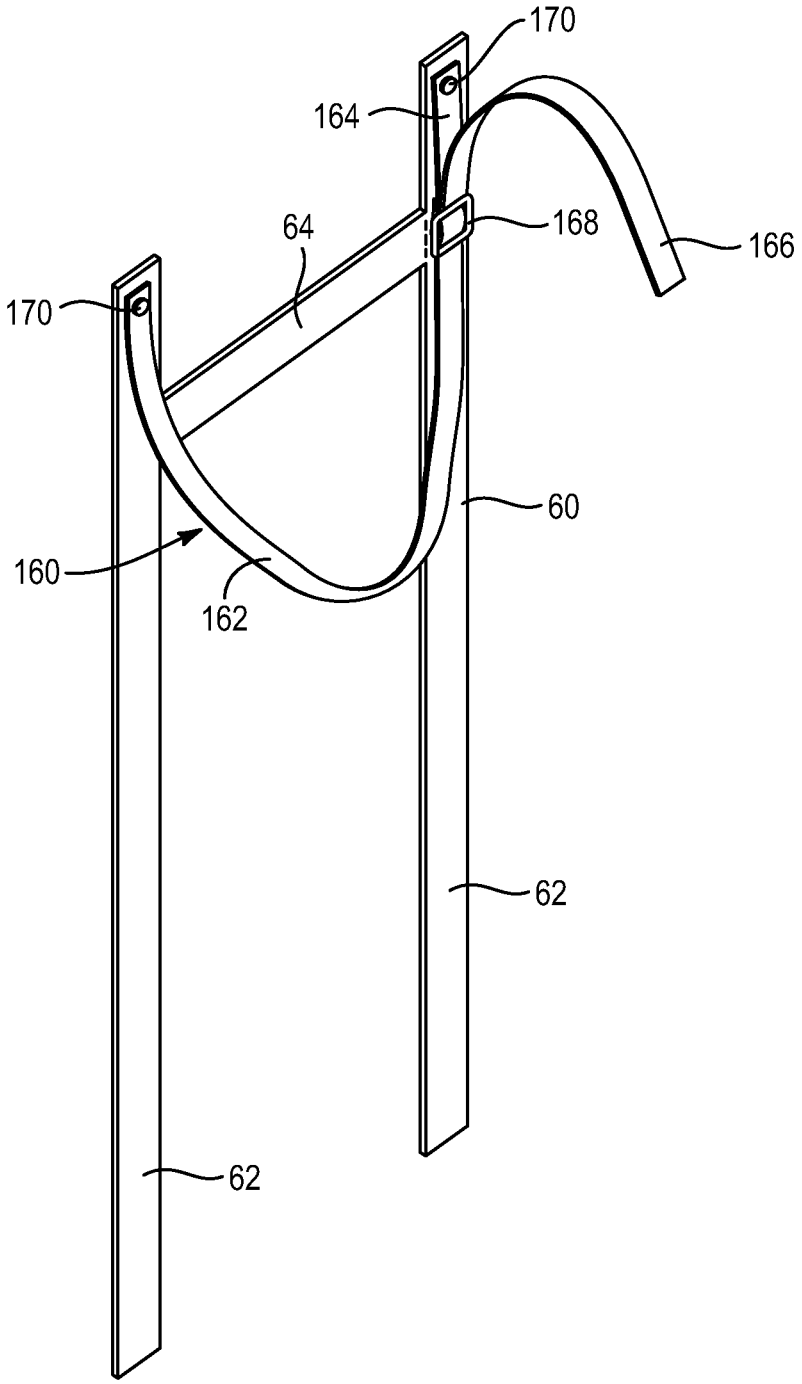
FIG. 12 is a perspective view of a backpack frame having another arm, according to some embodiments.

FIG. 12 depicts an arm 160 that is non-rigid, according to some embodiments. As illustrated, in some instances, the arm 160 comprises an adjustable strap. The arm 160 includes two strap portion 162, 164 connected by a connector 168 through which the length of the arm 160 can be adjusted. Extra strap length 166 of one of the strap portions 162 that can be used to enlarge the size of the arm 160 extends out of the connector 168. The arm 160 can be coupled to the frame body 60 via one or more connectors 170. The connectors can include nuts, bolts, screws, brads, loops, rings, or other means for connecting a strap to the frame body 60. In some configurations, the connectors 170 form a pivot point about which the arm 160 can pivot when the head of an animal is inserted into the space between the arm 160 and the frame body 60. The arm 160 can function similar to a rigid arm in that the weight of an animal head draws the strap downward, locking the antlers in place. Additionally, once the animal's head is locked in place, the arm 160 can be tightened by decreasing the length of the strap 162 to further lock the head in place.

Figure 13:
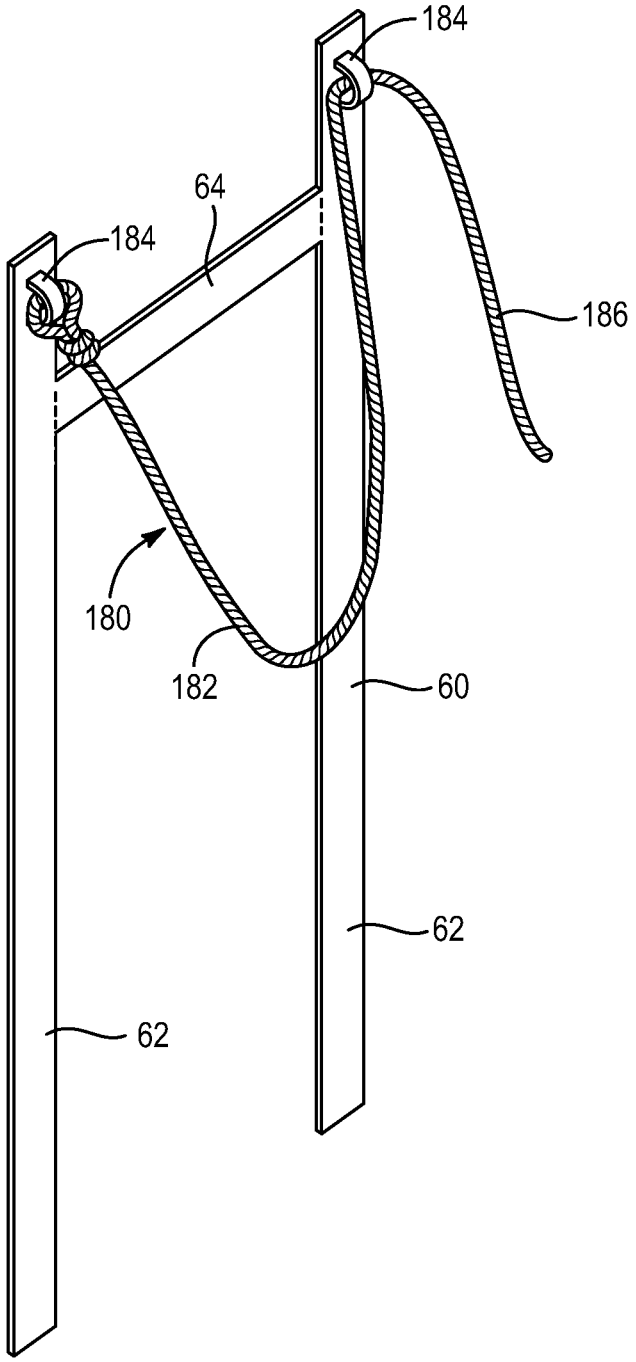
FIG. 13 is a perspective view of a backpack frame having another arm, according to some embodiments.

FIG. 13 depicts another embodiment of a non-rigid arm 180 that comprises a rope instead of a strap. The rope functions similar to a strap. In some embodiments, the rope can include a connector 168 similar to that of FIG. 12, which adjusts the length of the rope. In other embodiments, the rope is tied to one or more connectors 184 on the frame body 60 and its length is adjusted by varying the amount of rope portion 186 pulled through the connectors 184 versus the rope portion 182 that is not pulled through the connector 184, but which forms a loop and space through which an animal head is inserted.

Figure 14:
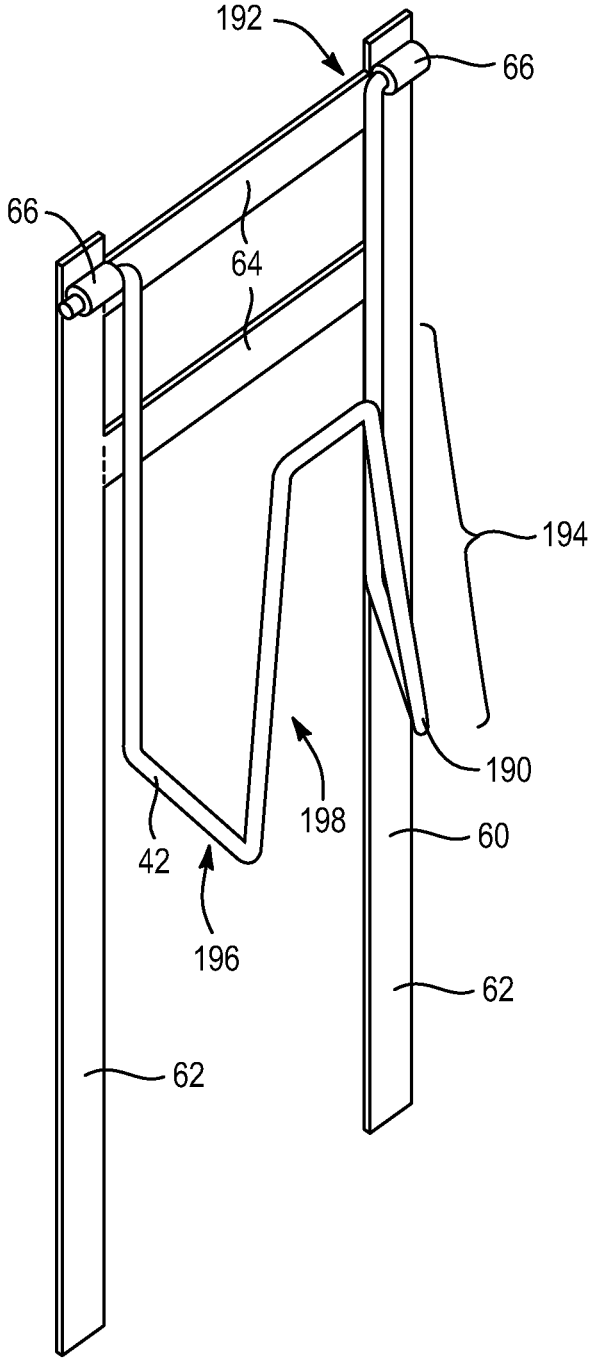
FIG. 14 is a perspective view of a backpack frame having another arm, according to some embodiments.

FIG. 14 depicts another embodiment of a rigid arm 190 that includes multiple contours 42 that combine to form a hook-shape 196, according to some embodiments. The proximal portion 196 of the arm 190 is coupled to the frame 60 via connectors 66. As shown, in some configurations, the distal portion 194 of the arm 190 extends away from the proximal portion 192 and is subsequently bent back around to form a hook-shape 196. A space 198 is formed between this distal portion 194 of the arm 190 and the frame into which the head of an animal can be inserted. The hook-shaped 196 arm 190 can receive and lock the head of an antlered animal therein, as the force of gravity forces the head into the hook, the head will be surrounded by the arm 190, which can secure the head and prevent excessive play therein. As the antlers of the animal press against the arm 190 they can prevent the head from falling out of hook of the arm 190. Accordingly, in some embodiments, a hook-shaped 196 arm 190 can be included with the backpack frame to support the head of an antlered animal.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A backpack frame comprising:

a frame body sized and configured for use with a backpack to be worn by a human, the backpack comprising material defining a front surface and a back surface of the backpack, the back surface being configured to contact a back of a wearer of the backpack, and the front surface being a surface of the backpack farthest from the wearer of the backpack when worn;

a rigid arm coupled to the frame body and being capable of pivoting at one or more points of connection between the arm and the frame body, the arm having a proximal portion at the one or more points of connection and a distal portion that is extended away from the one or more points of connection, wherein the arm is sized and configured such that when the distal portion of the arm is pivoted away from the frame body, the distal portion of the arm extends outward beyond the front surface of the backpack; and a space defined between the distal portion of the arm and the frame body when the arm is pivoted so that the distal portion is a maximum distance from the frame body is sufficiently sized to receive the head of an antlered animal therethrough.

2. The backpack frame of claim 1, wherein the arm is pivotally coupled to the body.

3. The backpack frame of claim 2, wherein the distal portion of the arm includes one or more contours that bow upwards in relation to the backpack frame when in use.

4. The backpack frame of claim 3, further comprising a bag coupled to the arm, wherein the bag does not contain the frame body therein.

5. The backpack frame of claim 4, wherein the bag has an opening, and wherein at least a portion of the perimeter of the opening is coupled to the arm.

6. The backpack frame of claim 3, wherein the one or more contours bows upward from a general plane of the arm, when the arm is extended substantially horizontally, between twenty and seventy-five percent of a maximum width of the space defined between the distal portion of the arm and the frame body.

7. The backpack frame of claim 1, further comprising:

a stand coupled to the frame body; and an accessory adapter coupled to a top portion of the stand.

8. The backpack frame of claim 7, wherein the accessory adapter is a tripod table.

9. The backpack frame of claim 2, further comprising one or more loops coupled to the arm.

10. The backpack frame of claim 6, wherein the one or more contours bows upward from the general plane of the arm, when the arm is extended substantially horizontally, between thirty and sixty percent of the maximum width of the space defined between the distal portion of the arm and the frame body.

11. The backpack frame of claim 10, wherein the one or more contours bows upward from the general plane of the arm, when the arm is extended substantially horizontally, between thirty-five and fifty percent of the maximum width of the space defined between the distal portion of the arm and the frame body.

12. The backpack frame of claim 1, wherein when the arm is pivoted downward, it is sized and configured to be stored within a compartment of the backpack, and when the arm is pivoted upward, at least the distal portion protrudes beyond the compartment of the backpack.

13. The backpack frame of claim 5, wherein the perimeter of the opening of the bag is greater than the perimeter of the space defined between the distal portion of the arm and the frame body, thereby permitting the bag to be threaded onto and off the arm and moved to a single side of the arm.

14. A backpack frame comprising:

a frame body sized and configured for use with a backpack to be worn by a human, the backpack comprising material defining a front surface and a back surface of the backpack, the back surface being configured to contact a back of a wearer of the backpack, and the front surface being a surface of the backpack farthest from the wearer of the backpack when worn;

a rigid arm forming at least a partial loop pivotally connected to the frame body such that the arm can assume a first position in which the arm extends downward proximate the frame body and a second position in which the arm extends outward substantially perpendicularly away from the frame body and past the front surface of the backpack;

a stand coupled to and extending upwardly from the frame body and including an adjustable member configured to permit varying the amount the stand extends upwardly from the frame body; and an accessory adapter coupled to a top portion of the stand.

15. The backpack frame of claim 14, wherein the adjustable member includes a rod disposed within a sleeve and a locking member that locks the rod in place relative to the sleeve, the accessory adapter being disposed on an end of the rod.

16. The backpack frame of claim 14, wherein the accessory adaptor is a tripod table.

17. The backpack frame of claim 14, wherein the arm comprises a distal portion extended away from one or more points of connection between the arm and the frame body, and wherein the distal portion comprises a contour that extends from a general plane of the arm, between twenty and seventy-five percent of a maximum width of a space defined between the arm and the frame body.

* * * * *